United States Patent [19]

Steiner

[11] Patent Number: 4,595,089

[45] Date of Patent: Jun. 17, 1986

[54] WEAVING MACHINE

[75] Inventor: Alois Steiner, Rieden, Switzerland

[73] Assignee: Sulzer-Ruti Machinery Work, Ltd., Ruti, Switzerland

[21] Appl. No.: 693,092

[22] Filed: Jan. 22, 1985

[30] Foreign Application Priority Data

Jan. 25, 1984 [EP] European Pat. Off. ..... 84100750.3

[51] Int. Cl.[4] ..... D03D 47/00

[52] U.S. Cl. ..... 139/11; 139/28; 139/188 R

[58] Field of Search ..... 139/188 R, 28, 304, 139/190, 191, 11 R, 11 A

[56] References Cited

U.S. PATENT DOCUMENTS 3,779,286 12/1973 Pfarrwaller ..... 139/25

4,051,872 10/1977 Komarov ..... 139/191

4,388,951 6/1983 Atkinson ..... 139/191

*Primary Examiner*—Henry S. Jaudon

*Attorney, Agent, or Firm*—Kenyon & Kenyon

[57] ABSTRACT

The weaving machine has a weaving rotor with beating-up lamellae each of which has a beating-up edge perpendicular to the beating-up line during beating-up of the weft yarn. In addition, a rotatable shell is provided to operate after each beating up of a weft yarn in order to draw the cloth in the take-off direction at at least the peripheral velocity of the beating-up lamellae until these lamellae pass out of engagement with the cloth. The shell can be oscillated in synchronism with the beating-up operation via a cam disc coaxial with the rotor and a linkage secured to and end of the rotatable shell 9. The arrangement prevents the cloth from being displaced from the cloth plane by the beating-up lamellae.

19 Claims, 6 Drawing Figures

WEAVING MACHINE

This invention relates to a weaving machine. More particularly, this invention relates to a series-shed weaving machine.

Heretofore, it has been known to construct a weaving machine in a manner so as to create superposed sheds while employing a weaving rotor on which combs of lamella are disposed for the beating-up of yarns into the sheds. During operation, a weft yarn is picked into a shed and beaten-up along a beating-up line into a cloth at the apex of the shed. However, one difficulty which may arise during beating-up is that a comb may urge the cloth on the beating-up line away from the warp and cloth plane. In this case, it becomes difficult, if not impossible, to maintain the requisite weft density. The point is that, in rotary beating-up, the warp yarns move from the lamellae at some part of the periphery of the lamellae.

In the past, the lamellae of the beating-up combs have been provided with a curvilinear beating-up edge at the place of departure on the lamellae periphery. At this place, the beating-up edge is at an angle to the warp and cloth plane, for example at an angle of approximately 30° to 45°. However, at this angle, there is a risk with some cloth articles that the beating-up edges may easily displace the cloth from the plane of the beating-up line.

Accordingly, it is an object of the invention to prevent displacement of a cloth by the beating-up edge of a lamella of a beating-up comb in a superposed shed weaving machine.

It is another object of the invention to improve the quality of cloth produced on a series-shed weaving machine.

It is another object of the invention to maintain a cloth in a cloth plane during beating-up of a weft yarn by a beating-up comb on a weaving rotor.

Briefly, the invention provides a superposed weaving machine with a plurality of beating-up lamellae in which each lamella has a beating-up edge for beating-up a weft yarn into a cloth which is disposed in perpendicular relation to a beating-up line during beating-up. Consequently, the lamellae cannot displace the cloth from the warp and cloth plane during the beating-up of a weft yarn.

In addition, the weaving machine is provided with means for pulling the cloth in a take-off direction at at least the peripheral velocity of each beating-up edge after beating-up of a weft yarn. This enables the beating-up lamellae to move away from the cloth after beating-up.

Where the weaving machine is constructed with a rotor on which a plurality of combs of beating-up lamellae are mounted, the means for pulling the cloth may include a rotatably mounted member which is spaced from the rotor for receiving the cloth as well as means for oscillating the member in synchronism with the beating-up of a weft yarn at a shed apex. Further, where use is made of a stepping beam for conveying the cloth to a take-up position, the pulling may be in the form of cylindrical deflection shell having an open side facing the stepping beam with the cloth disposed over an upstream longitudinal edge of the shell. In this case oscillation of the shell causes the cloth to be pulled from the shed apex towards the stepping beam and thereafter released.

These and other objects and advantages of the invention will become more apparent from the following detailed description taken in conjunction with the accompanying drawings wherein.

Figures 3A, 3B, 3C, 3D:
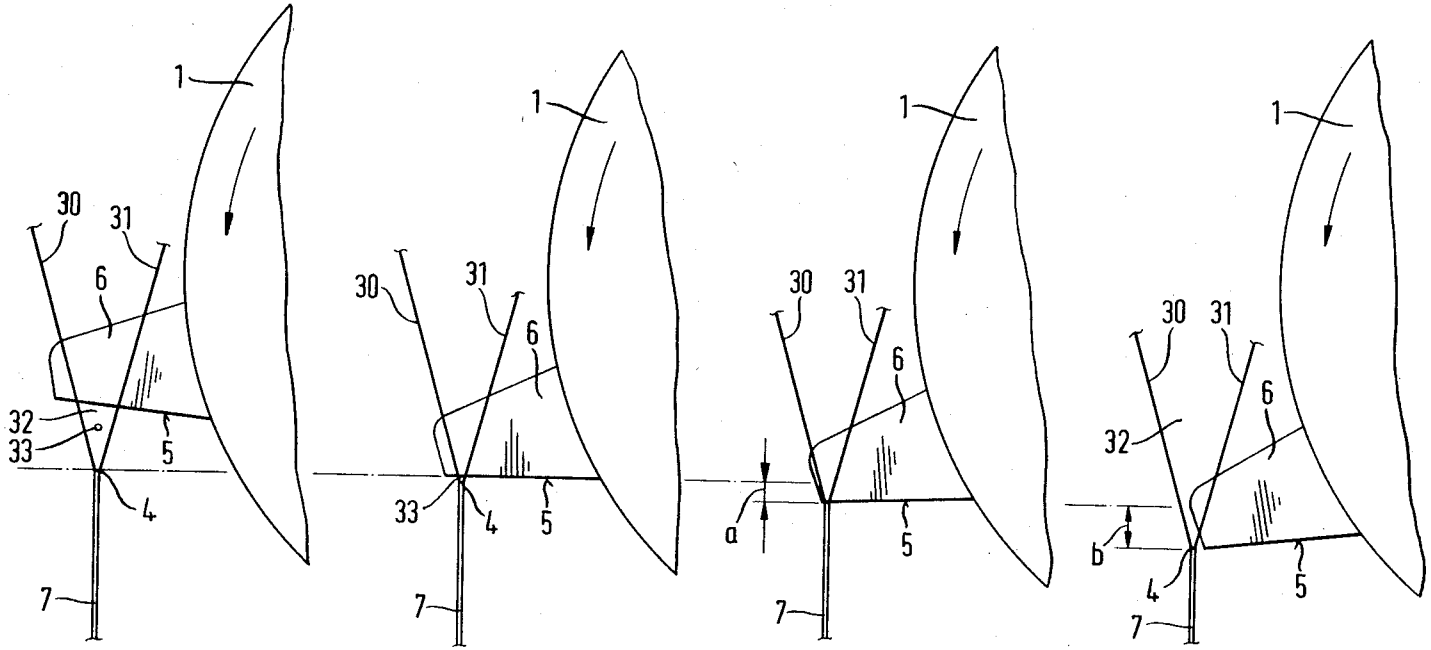

FIG. 3*a* diagramatically illustrates a lamella of a beating-up comb in a position prior to beating-up;

FIG. 3*b* diagramatically illustrates the lamella of FIG. 3*a* at a shed apex during beating-up;

FIG. 3*c* diagramatically illustrates the lamella of FIG. 3*a* in a position near the completion of beating-up; and FIG. 3*d* illustrates the lamella of FIG. 3*a* after beating-up.

Figure 1:
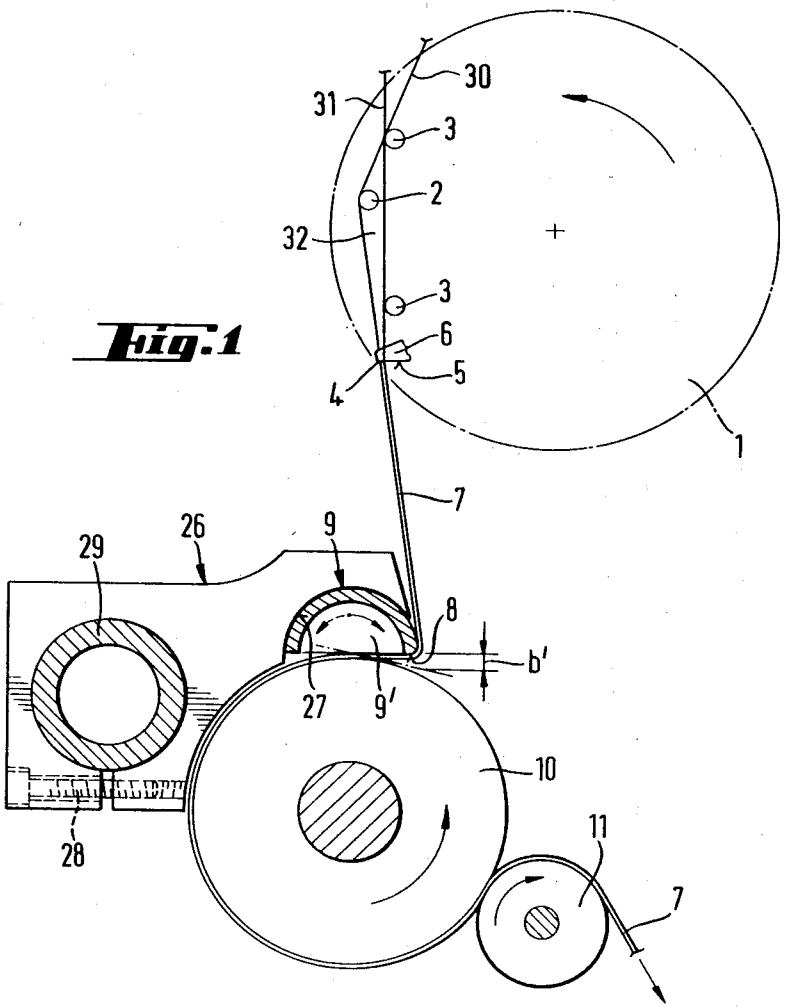
FIG. 1 illustrates a side view of a weaving machine having means for pulling a cloth in synchronism with the beating-up of a weft yarn by means of a rotatably mounted shell in accordance with the invention.

Referring to FIG. 1, the weaving machine is constructed in generally known manner and includes a weaving rotor 1 which is rotatably mounted about a horizontal axis, as viewed. The weaving rotor 1 carries a plurality of peripherally mounted picking combs (not shown) and beating-up combs (not shown) which are disposed in alternating relationship. In addition, shedding elements 2 for the upper shed position of the warp yarns 30 and shedding elements 3 for the lower shed position of the warp yarns 31 are disposed in the combs in known manner. As indicated, the warp yarns 30, 31 provide a shed 32 with a shed apex or tip 4 formed at the lowest point of the shed, as viewed.

Each beating-up comb is formed of a plurality of lamellae 6, only one of which is shown in FIG. 1. During rotation of the rotor 1, the lamellae of the particular beating-up comb concerned beats the weft yarn which has been picked into the shed via a suitable picking mechansim (not shown). To this end, each lamella has a beating-up edge 5 for beating-up the weft yarn into a cloth 7. As indicated in FIG. 3, each edge 5 of a lamella 6 is formed so as to be disposed in perpendicular relation to a beating-up line during beating-up of a weft yarn 33.

As shown in FIG. 1, the weaving machine is provided with a means for pulling the cloth 7 in a take-off direction at at least the peripheral velocity of the edge 5 of the lamella after beating-up of the weft yarn 33. As indicated, this pulling means includes a rotatable pull member 9 which is in the form of a cylindrical deflection shell. The shell 9 extends over the whole width of the cloth 7 and is rotatably mounted at the ends in uprights of the weaving machine frame. In this respect, the shell 9 has cylindrical ends. In addition, the shell 9 has an open side 9' which faces a stepping beam over which the cloth 7 passes to a deflecting beam 11 and, thence, to a cloth beam (not shown) on which the cloth 7 is wound. As indicated, the cloth 7 passes over an upstream longitudinal edge 8 of the shell 9 prior to passing onto the stepping beam 10 which is continuously rotating during operation. As indicated, the upstream edge 8 of the shell 9 is spaced a predetermined distance b' from the stepping beam 10 in a normal rest position.

Figure 2:
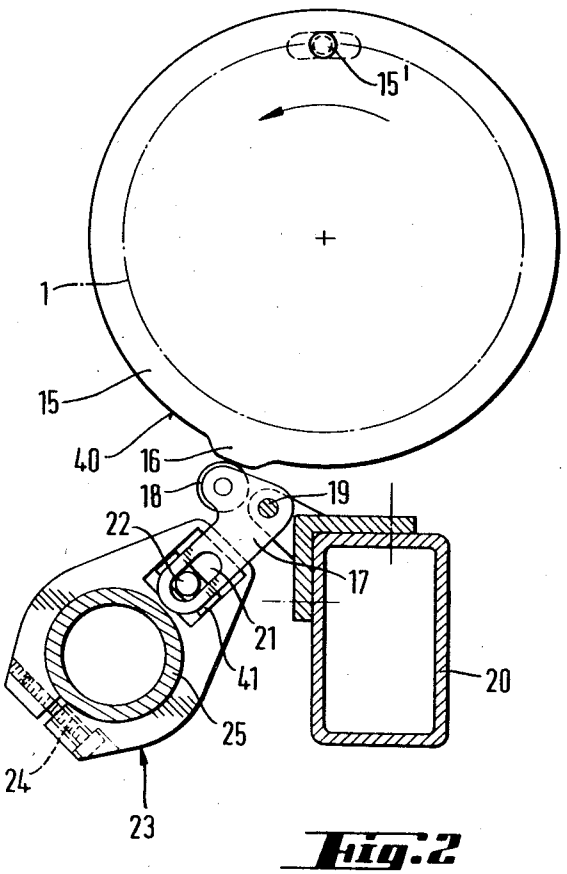
FIG. 2 illustrates a side view of a means for oscillating the shell of FIG. 1 in accordance with the invention.

The means for pulling the cloth 7 in the take-off direction also includes a means for oscillating the shell 9 in synchronism with the beating-up of a weft yarn 33 at the shed apex 4. As indicated in FIG. 2, this oscillating means includes a cam disc 15 which is mounted for rotation coaxially with the rotor 1. To this end, the cam disc 15 is adjustably secured to one end of the weaving rotor 1, for example via a screw 15'. This cam disc 15 carries a plurality of circumferentially disposed cams 16 (only one of which is shown) which are of a number equal to the number of beating-up combs on the rotor 1. In addition, a linkage is secured to one end of the shell 9 for pivoting the shell 9 in reaction to the influence of each cam 16.

As indicated in FIG. 2, the linkage between the cam disc 15 and the shell 9 includes a toggle lever 17 which is pivotally mounted on a spindle 19 secured to a frame 20 of the weaving machine. One arm of the lever 17 carries a cam follower 18 which rolls along the cam surface of the cam disc 15 while the second arm is formed with a slot 21 to receive a pin 22. The pin 22 is, in turn, secured in a slide block 41 which is slidably mounted within a slot of a lever 23 which is clamped via a screw 24 to a closed part 25 of the shell 9.

Referring to FIG. 1, in order to strengthen the shell 9 against arching due to the tension of the warp or cloth, a number of brackets 26 are secured to the weaving machine and each is formed with a recess 27 in which the shell 9 engages. As indicated, each bracket 26 is clamped via a screw 28 to a spindle 29 which extends across the width of the weaving frame. The screw 28, upon loosening, permits each bracket 26 to be moved lengthwise of the spindle 29.

During operation, with the weaving rotor 1 and stepping roller 10 being continuously driven in the directions indicated by the arrows in FIG. 1, a weft yarn 33 is picked into each shed 32 which is sequentially formed. After picking, each weft yarn 33 is moved in a beating-up line from a position as indicated in FIG. 3*a* to the shed apex as indicated in FIG. 3*b* by the lamellae of a beating-up comb.

At the initiation of beating-up of the weft yarn 33, the edge 5 of each lamellae of the comb is in a position corresponding to the shed apex 4. In this position, the edge 5 is perpendicular to the beating-up line as well as to the plane of the cloth 7 which extends downwardly from the shed apex 4, as viewed. At this time, the lamella 6 depresses the shed 32 downwards by a reduced distance a (FIG. 3*c*) with the weft yarn 33 being beaten-up tightly into the cloth 7. Near the end of this beating-up movement, the cam 16 of the disc 15 causes a counter-clockwise rotation of the cam roller 18 (see FIG. 2) and lever 17 so that the lever 23 and, therefore, the shell 9 rotate clockwise. Thus, the bottom edge 8 of the shell 9 moves downwardly a distance b' with the cloth 7 being correspondingly drawn downwardly as indicated in FIG. 3*d* by a distance b and away from the edge 5 of the lamella 6. In this regard, the cloth 7 is drawn downwardly at a speed at least equal to the peripheral speed of the edge 5. Since the lamella 6 moves in a circular arc or orbit, the lamella can move away from the shed 32 and below the cloth 7.

After the lamella 6 has passed by the cloth 7, the cam roller 18 re-engages with the main circular part 40 of the disc 15 so that the lever 17 rotates clockwise as viewed in FIG. 2. The shell 9 then rotates counter-clockwise so that the deflecting edge 8 rises and releases the cloth 7 so that the cloth 7 may return into the position before the beating-up of the weft yarn 33.

In order that the amount by which the cloth 7 is drawn back may be adjusted, the position of the slide block 41 within the lever 23 can be adjusted in order to adjust the lever relationship of the levers 17, 23 and, therefore, the deflection of the lever 23. In this way, the linkage is adjustable to vary the actuation of the shell 9 relative to the rotor 1.

Preferrably, the angle between the beating-up edge of a lamella 6 and the plane of the cloth 7 is from 84° to 96° during beating-up and, preferably 90° to the plane of the cloth 7.

In order to adjust the timing of the drawing-back movement of the shell 9, the cam disc may be adjusted relative to the rotor 1. To this end, after the screw 15' has been loosened, the disc 15 can be rotated relative to the rotor 1 in the approprate direction and then set in place by tightening of the screw 15'.

The invention thus provides a relatively simple apparatus for maintaining the cloth 7 in the plane of the beating-up line. To this end, the cloth 7 can be readily drawn a predetermined distance from the shed apex in synchronism with the beating-up of a weft yarn at a speed at least equal to the peripheral speed of the edge of the beating-up lamellae. This allows the cloth 7 to move away from the shed apex while the lamellae also moves out of the plane of the cloth after beating-up of a weft yarn 33.

In addition to being useful in a series shed weaving machine, the above described apparatus is also of use in a weaving machine having a rotary beating-up comb. Furthermore, the beating-up lamellae can be disposed on a helix or on a cylinder generatrix.

What is claimed is:

1. In a series-shed weaving machine, the combination comprising a plurality of beating-up lamella, each of said lamella having a beating-up edge for beating-up a weft yarn into a cloth, each edge being disposed in perpendicular relation to the plane of the cloth during beating-up; and means for pulling the cloth in a take-off direction at at least the peripheral velocity of each said edge after beating-up of a weft yarn.

2. The combination as set forth in claim 1 wherein said means includes a rotatable pull member extending over the cloth width for engaging and pulling the cloth.

3. The combination as set forth in claim 2 which further comprises a stepping beam for conveying the cloth to a take-up position and wherein said pull member is a cylindrical deflection shell having an open side facing said stepping beam with the cloth disposed over an upstream longitudinal edge of said shell.

4. The combination as set forth in claim 3 further comprising a rotor having said lamella thereon and a cam disc connected to said rotor for rotating said shell.

5. The combination as set forth in claim 4 further comprising a linkage between said cam disc and said shell for actuating said shell from said cam disc.

6. The combination as set forth in claim 5 wherein said linkage is adjustable to vary the actuation of said shell relative to said rotor.

7. The combination as set forth in claim 4 wherein said cam disc is adjustable relative to said rotor.

8. The combination as set forth in claim 1 wherein each said edge extends at an angle of from 84° to 96° to said beating-up line during beating up.

9. In a weaving machine, the combination of a rotor;

at least one lamella mounted on said rotor and having an edge for beating-up a weft yarn into a cloth at a shed apex; and means for pulling the cloth a predetermined distance from said shed apex in synchronism with the beating-up of a weft yarn and at a speed at least equal to the peripheral speed of said lamella edge.

10. The combination as set forth in claim 9 wherein said means includes a rotatably mounted shell spaced from said rotor for receiving the cloth over an upstream edge, a cam disc mounted for rotation coaxiallv with said rotor and a linkage between said cam disc and said shell for pivoting said shell in synchronism with the beating-up of a weft at said shed apex.

11. The combination as set forth in claim 10 wherein said cam disc is adjustably mounted relative to said rotor for adjusting the rotation of said shell relative to said rotor.

12. The combination as set forth in claim 10 wherein said linkage is adjustable to vary said predetermined distance.

13. The combination as set forth in claim 9 wherein said edge is disposed at an angle of from 84° to 96° relative to a plane of the cloth extending through said shed apex.

14. The combination as set forth in claim 13 wherein said edge is perpendicular to said plane during beating-up.

15. The combination as set forth in claim 9 wherein siad means includes a rotatably mounted member spaced from said rotor for receiving the cloth and means for oscillating said member in synchronism with the beating-up of a weft yarn at said shed apex to draw the cloth away from said shed apex after beating-up of the weft yarn.

16. The combination as set forth in claim 15 wherein said means for oscillating said member includes a linkage secured to one end of said member and a cam disc rotatably mounted with said rotor for periodically actuating said linkage to oscillate said member.

17. A series shed weaving machine comprising a weaving rotor having a plurality of shedding elements and a plurality of beating-up combs disposed thereon, each said comb including a plurality of lamellae for beating-up of a weft yarn, each said lamella having a beating-up edge for beating-up a weft yarn into a cloth with said edge disposed in perpendicular relation to the plane of the cloth during beating-up of a weft yarn; and means for pulling the cloth in a take-off direction at at least the peripheral velocity of a respective lamella after beating-up of a weft yarn to permit said respective lamella to pass by the cloth.

18. A series shed weaving machine as set forth in claim 17 which further comprises a stepping beam for conveying the cloth to a take-up position and said means for pulling is a cylindrical deflection shell having an open side facing said stepping beam with the cloth dispersed over an upstream longitudinal edge of said shell.

19. A series shed weaving machine as set forth in claim 18 further comprising a cam disc connected to said rotor for rotating said shell.

* * * * *